US011502421B2

(12) United States Patent
Kim et al.

(10) Patent No.: US 11,502,421 B2
(45) Date of Patent: Nov. 15, 2022

(54) ANTENNA

(71) Applicant: LG INNOTEK CO., LTD., Seoul (KR)

(72) Inventors: Young Hwan Kim, Seoul (KR); Sae Won Oh, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 27 days.

(21) Appl. No.: 17/255,864

(22) PCT Filed: Nov. 13, 2018

(86) PCT No.: PCT/KR2018/013747
§ 371 (c)(1),
(2) Date: Dec. 23, 2020

(87) PCT Pub. No.: WO2020/009283
PCT Pub. Date: Jan. 9, 2020

(65) Prior Publication Data

US 2021/0376487 A1 Dec. 2, 2021

(30) Foreign Application Priority Data

Jul. 3, 2018 (KR) ..... 10-2018-0077222

(51) Int. Cl.

| | |
|---|---|
| ***H01Q 21/06*** | (2006.01) |
| ***H01Q 13/02*** | (2006.01) |
| ***H01Q 1/36*** | (2006.01) |
| ***H01Q 1/52*** | (2006.01) |
| ***H01Q 21/00*** | (2006.01) |
| ***H01Q 1/50*** | (2006.01) |

(52) U.S. Cl.
CPC ..... *H01Q 21/064* (2013.01); *H01Q 1/36* (2013.01); *H01Q 1/50* (2013.01); *H01Q 1/521* (2013.01); *H01Q 13/02* (2013.01); *H01Q 21/0006* (2013.01); *H01Q 21/061* (2013.01)

(58) Field of Classification Search
CPC .... H01Q 21/064; H01Q 13/02; H01Q 21/205; H01P 3/10
See application file for complete search history.

(56) References Cited

U.S. PATENT DOCUMENTS

| | | | | |
|---|---|---|---|---|
| 4,743,915 A | | 5/1988 | Rammos et al. | |
| 5,243,357 A | * | 9/1993 | Koike | H01Q 19/195 343/778 |
| 7,091,921 B2 | * | 8/2006 | Ohno | H01Q 21/0037 343/771 |
| 10,158,158 B2 | * | 12/2018 | Kirino | H01P 1/025 |

(Continued)

FOREIGN PATENT DOCUMENTS

| | | |
|---|---|---|
| CN | 102882014 A | 1/2013 |
| JP | 9-284036 A | 10/1997 |

*Primary Examiner* — Vibol Tan
(74) *Attorney, Agent, or Firm* — Birch, Stewart, Kolasch & Birch, LLP

(57) ABSTRACT

According to one embodiment, disclosed is an antenna comprising: a first waveguide having a first signal transmission path; a second waveguide connected to the first waveguide; and an antenna unit connected to the second waveguide and having a first opening, wherein the second waveguide comprises a first separator for separating the signal transmission path, and the antenna unit comprises a first antenna unit and a second antenna unit.

19 Claims, 13 Drawing Sheets n-n'

I-I'

(56) References Cited

U.S. PATENT DOCUMENTS

| | | | | |
|---|---|---|---|---|
| 11,275,937 | B2 * | 3/2022 | Kominis | G06V 40/18 |
| 2009/0303147 | A1 | 12/2009 | Choudhury | |
| 2017/0229752 | A1 * | 8/2017 | Kirino | H01Q 1/50 |
| 2017/0271740 | A1 | 9/2017 | Chieh et al. | |

* cited by examiner

FIG. 12

| EIA marking | Internal size (mm * mm) | Operating frequency (Ghz) | Cut-off frequency(Ghz) |
|---|---|---|---|
| WR-2300 | 584,2 * 292,1 | 0,32 ~ 0,49 | 0,257 |
| WR-2100 | 533,4 * 266,7 | 0,35 ~ 0,53 | 0,281 |
| WR-1800 | 457,2 * 228,6 | 0,41 ~ 0,62 | 0,328 |
| WR-1500 | 381 * 190,5 | 0,49 ~ 0,75 | 0,394 |
| WR-1150 | 292,1 * 146,05 | 0,64 ~ 0,98 | 0,514 |
| WR-975 | 247,65 * 123,83 | 0,76 ~ 1,15 | 0,606 |
| WR-770 | 195,5 * 97,79 | 0,96 ~ 1,46 | 0,767 |
| WR-650 | 165,1 * 82,55 | 1,12 ~ 1,7 | 0,909 |
| WR-510 | 129,54 * 64,77 | 1,45 ~ 2,2 | 1,158 |
| WR-430 | 109,22 * 54,61 | 1,7 ~ 2,6 | 1,373 |
| WR-340 | 86,36 * 43,18 | 2,17 ~ 3,3 | 1,737 |
| WR-284 | 72,14 * 34,04 | 2,6 ~ 3,95 | 2,079 |
| WR-229 | 58,17 * 29,08 | 3,22 ~ 4,9 | 2,579 |
| WR-187 | 47,55 * 22,15 | 3,95 ~ 5,85 | 3,155 |
| WR-159 | 40,39 * 20,19 | 4,64 ~ 7,05 | 3,714 |
| WR-137 | 34,85 * 15,8 | 5,85 ~ 8,2 | 4,304 |
| WR-112 | 28,5 * 12,62 | 7,05 ~ 10 | 5,263 |
| WR-90 | 22,86 * 10,16 | 8,2 ~ 12,4 | 6,562 |
| WR-75 | 19,05 * 9,53 | 9,84 ~ 15 | 7,874 |
| WR-62 | 15,8 * 7,9 | 12,4 ~ 18 | 9,494 |
| WR-51 | 12,95 * 6,48 | 14,5 ~ 22 | 11,583 |
| WR-42 | 10,7 * 4,3 | 18 ~ 26,5 | 14,058 |
| WR-34 | 8,64 * 4,32 | 21,7 ~ 33 | 17,361 |
| WR-28 | 7,11 * 3,56 | 26,5 ~ 40 | 21,097 |
| WR-22 | 5,7 * 2,8 | 33 ~ 50,5 | 26,362 |
| WR-19 | 4,8 * 2,4 | 40 ~ 60 | 31,381 |
| WR-15 | 3,8 * 1,9 | 50 ~ 75 | 39,894 |
| WR-12 | 3,1 * 1,5 | 60 ~ 90 | 48,387 |
| WR-10 | 2,54 * 1,27 | 75 ~ 110 | 59,055 |
| WR-8 | 2,03 * 1,02 | 90 ~ 140 | 73,892 |
| WR-7 | 1,7 * 0,83 | 110 ~ 170 | 90,909 |
| WR-5 | 1,3 * 0,648 | 140 ~ 220 | 115,385 |
| WR-4 | 1,09 * 0,56 | 172 ~ 261 | 137,615 |
| WR-3 | 0,86 * 0,43 | 217 ~ 333 | 174,419 |

All 5G bands cover wave guide

ANTENNA

CROSS REFERENCE TO RELATED APPLICATIONS

This application is the National Phase of PCT International Application No. PCT/KR2018/013747, filed on Nov. 13, 2018, which claims priority under 35 U.S.C. 119(a) to Patent Application No. 10-2018-0077222, filed in the Republic of Korea on Jul. 3, 2018, all of which are hereby expressly incorporated by reference into the present application.

TECHNICAL FIELD

In the present disclosure, an antenna for transmission and reception of electromagnetic waves is disclosed.

BACKGROUND ART

A conventional array patch antenna is formed in a patch-type array structure and has directivity. That is, it has high performance only in a specific direction, not all directions. Therefore, there is a problem that there are directions that cannot be covered.

In addition, the conventional array patch antenna has a problem in that a performance change occurs according to a dielectric constant of a substrate and deviation in the substrate. Therefore, it is common to use a Teflon substrate or a Rogers substrate rather than a substrate such as FR4 having a high dielectric constant and relatively high loss. However, when a Teflon substrate or a Rogers substrate is used, there is a problem in that the product unit cost is high due to the expensive material cost and processing cost.

Therefore, many companies and researchers are developing technologies for new substrates or new types of array methods. In particular, there is an industrial need for an antenna with high performance in various directions.

SUMMARY

The present disclosure may provide an antenna. Specifically, an antenna capable of communicating in various directions is disclosed. The technical problem to be solved is not limited to the technical problems as described above, and various technical problems may be further included within a range that is obvious to a person skilled in the art.

An antenna comprising: a first waveguide having a first signal transmission path; a second waveguide connected to the first waveguide and having a second signal transmission path and a third signal transmission path; and an antenna unit connected to the second waveguide and having a first opening, wherein the second waveguide includes a first separator separating the first signal transmission path from the second signal transmission path and the third signal transmission path, wherein the antenna unit includes a first antenna and a second antenna, and wherein the first opening of the first antenna is connected to the second signal transmission path, and the first opening of the second antenna is connected to the third signal transmission path.

In addition, the second signal transmission path and the third signal transmission path are in a vertical direction to the first signal transmission path.

In addition, the second waveguide includes a second separator separating the second signal transmission path into two signal transmission paths.

In addition, the second waveguide includes a third separator separating the third signal transmission path into two signal transmission paths.

In addition, the antenna unit includes a third antenna adjacent to the first antenna and a fourth antenna adjacent to the second antenna.

In addition, the second separator of the second waveguide is disposed between the first antenna unit and the third antenna unit, and the third separator of the second waveguide is disposed between the second antenna unit and the fourth antenna unit.

wherein the first antenna and the second antenna are disposed in opposite direction from each other, and the third antenna and fourth antenna are disposed in opposite direction from each other.

wherein the first antenna and the second antenna include a second opening larger than the first opening, and the second opening of the first antenna and the second opening of the second antenna are disposed in opposite direction from each other.

An antenna according to the second aspect comprises: a first waveguide; a second waveguide disposed in a direction perpendicular to the first waveguide; and an antenna unit disposed in a horizontal direction with the second waveguide, wherein the antenna unit includes a first antenna disposed in a first direction, a second antenna disposed in a second direction opposite to the first direction, a third antenna disposed in a direction perpendicular to the first direction, and a fourth antenna disposed in a direction perpendicular to the second direction, and wherein the second waveguide includes a first separator disposed to correspond to the first waveguide, a second separator disposed between the first antenna and third antenna, and a third separator disposed between the second antenna and the fourth antenna.

In addition, an antenna according to the third aspect comprises: a signal transmission path; a separator separating the signal transmission path into a plurality of signal transmission paths; and a plurality of antenna corresponding to the plurality of signal transmission paths separated by the separator, wherein the plurality of antenna is disposed facing different directions from one another.

Advantageous Effects

In the present disclosure, an antenna for transmitting and receiving electromagnetic wave signals over a wide area is disclosed.

BRIEF DESCRIPTION OF THE DRAWINGS

FIG. 12 is a diagram illustrating a size of a first waveguide according to an embodiment.

DETAILED DESCRIPTION OF THE EMBODIMENTS

Figure 1:
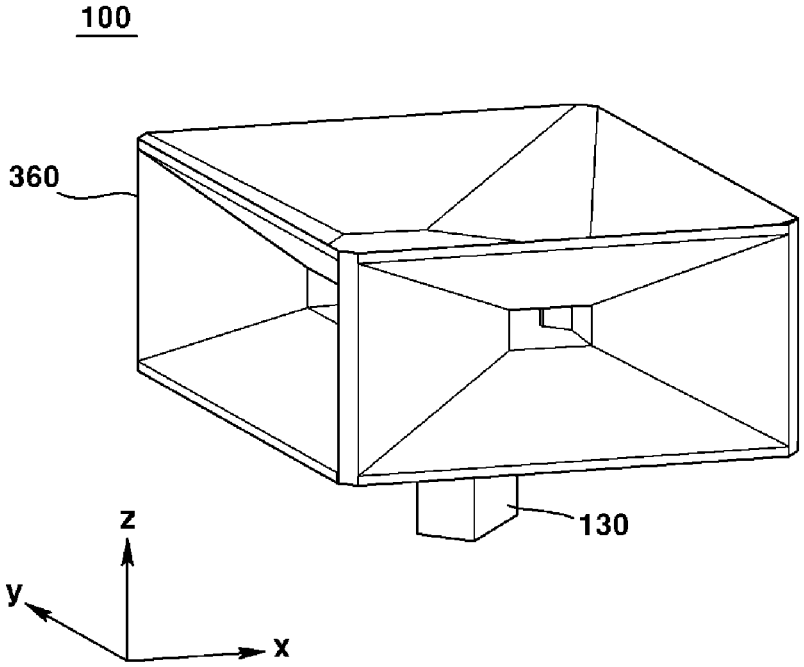
FIG. 1 is a diagram illustrating a perspective view of an antenna according to an embodiment.

Hereinafter, embodiments of the present invention will be described in detail with reference to the accompanying drawings. Advantages and features of the present invention and a method of achieving them will be apparent with reference to the embodiments described below in detail together with the accompanying drawings. However, the present invention is not limited to the embodiments to be published below, but may be implemented in various different forms. It is provided to fully inform the scope of the invention to those of ordinary skill in the art to which the present invention belongs, and the invention is only defined by the scope of the claims. The same reference numerals refer to the same components throughout the specification.

Unless otherwise defined, all terms (including technical and scientific terms) used in the present specification may be used as meanings that can be commonly understood by those of ordinary skill in the art to which the present invention belongs. In addition, terms defined in a commonly used dictionary are not interpreted ideally or excessively unless explicitly defined specifically.

In addition, terms used in the present specification are for describing embodiments and are not intended to limit the present invention. In this specification, the singular form also includes the plural form unless specifically stated in the phrase. 'Comprises' and/or 'comprising' as used in the specification means is used as a meaning not to exclude the presence or addition of one or more other components, steps and/or actions other than the mentioned components, and steps and/or actions. And, "and/or" includes each and every combination of one or more of the recited items.

In addition, in describing the constituent elements of an embodiment of the present invention, terms such as first, second, A, and B may be used. These terms are only for distinguishing the component from other components, and the nature, order, or order of the component is not limited by the term. When a component is described as being 'connected', 'coupled' or 'interconnected' to another component, the component may be directly connected, coupled or connected to the other component, but the component and the other component It should be understood that another component may be 'connected', 'coupled' or 'interconnected' between elements.

Hereinafter, embodiments of the present invention will be described in detail with reference to the accompanying drawings so that those of ordinary skill in the art may easily implement the present invention. However, the present invention may be implemented in various forms and is not limited to the embodiments described herein.

An embodiment of the present disclosure may be initiated according to x, y, and z directions, and the z direction may be interpreted as an upward (upward) direction.

In the description of the embodiment according to the present invention, in the case where it is described as being formed in "upper (top) or lower (below) (on or under)" of each element, the upper (top) or lower (below) (on or under) includes both elements in direct contact with each other or in which one or more other elements are indirectly formed by being disposed between the two elements. In addition, when expressed as "upper (top) or lower (below) (on or under)", the meaning of not only an upward direction but also a downward direction based on one element may be included.

Hereinafter, embodiments of the present invention will be described in detail with reference to the drawings.

FIG. 1 is a diagram illustrating a perspective view of an antenna 100 according to an exemplary embodiment.

The antenna 100 according to an embodiment may be connected to a circuit. The substrate may be a component of a circuit. Accordingly, the antenna 100 may be connected to a substrate or one component included in the substrate.

The substrate may be formed of a material such as low temperature co-fired ceramic (LTCC), Rogers, Teflon, or organic FR4. Considering the price aspect, it may be desirable to use an inexpensive organic series FR4, but LTCC may be used to implement excellent characteristics in a high frequency band.

The substrate may be a dielectric substrate having a constant dielectric constant. In addition, in the present disclosure, the thickness of the substrate may vary depending on the subject to which the antenna is applied or the curvature, and there is no particular limitation on the thickness of the substrate.

In addition, as illustrated in FIG. 1, a right direction is described as an x direction, an upward direction is a y direction, and a vertical direction is a z direction.

In addition, although the present disclosure mainly discloses a case of radiating a signal (e.g., an electromagnetic wave signal), the antenna 100 may not only radiate a signal but also receive a signal. Specifically, the antenna 100 may perform signal reception in the reverse order of radiating the signal, and in order to simplify the overall description, a case of receiving a signal may be omitted in the present disclosure.

The antenna 100 according to an embodiment may include a first waveguide 130 and an antenna unit 360. According to an embodiment, the antenna unit 360 may be disposed in a vertical direction with the first waveguide 130.

Referring to FIG. 1, the antenna unit 360 may point toward a plurality of directions and may transmit and receive electromagnetic waves in a plurality of directions.

The antenna unit 360 may include a first antenna unit, a second antenna unit, and the like. In FIG. 1, although the antenna 100 is pointing toward four directions, but is not limited thereto. For example, the antenna 100 may be pointing toward 3 directions, 5 directions, 6 directions, or 8 directions depending on the number of apertures.

The antenna 100 according to an embodiment may cover all 360 degrees by pointing toward a plurality of directions. The antenna 100 may output the electromagnetic wave signal being received from the first waveguide 130 for the entire direction of 360 degrees or may receive the electromagnetic wave signal from the entire direction of 360 degrees.

The first antenna unit may include a plurality of plates, and the plurality of plates may have a trapezoidal shape in which the width is getting wider, but are not limited thereto.

Figure 2:
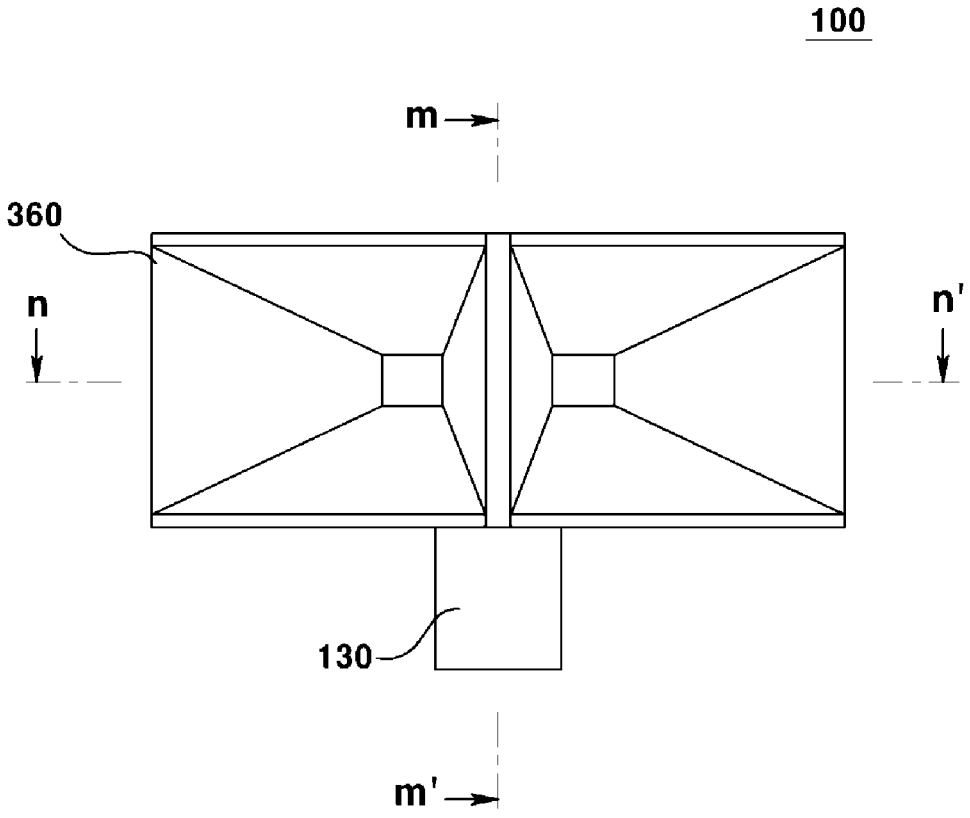
FIG. 2 is a diagram illustrating a front view of an antenna according to an embodiment.

FIG. 2 is a diagram illustrating a front view of an antenna 100 according to an embodiment.

Figure 4:
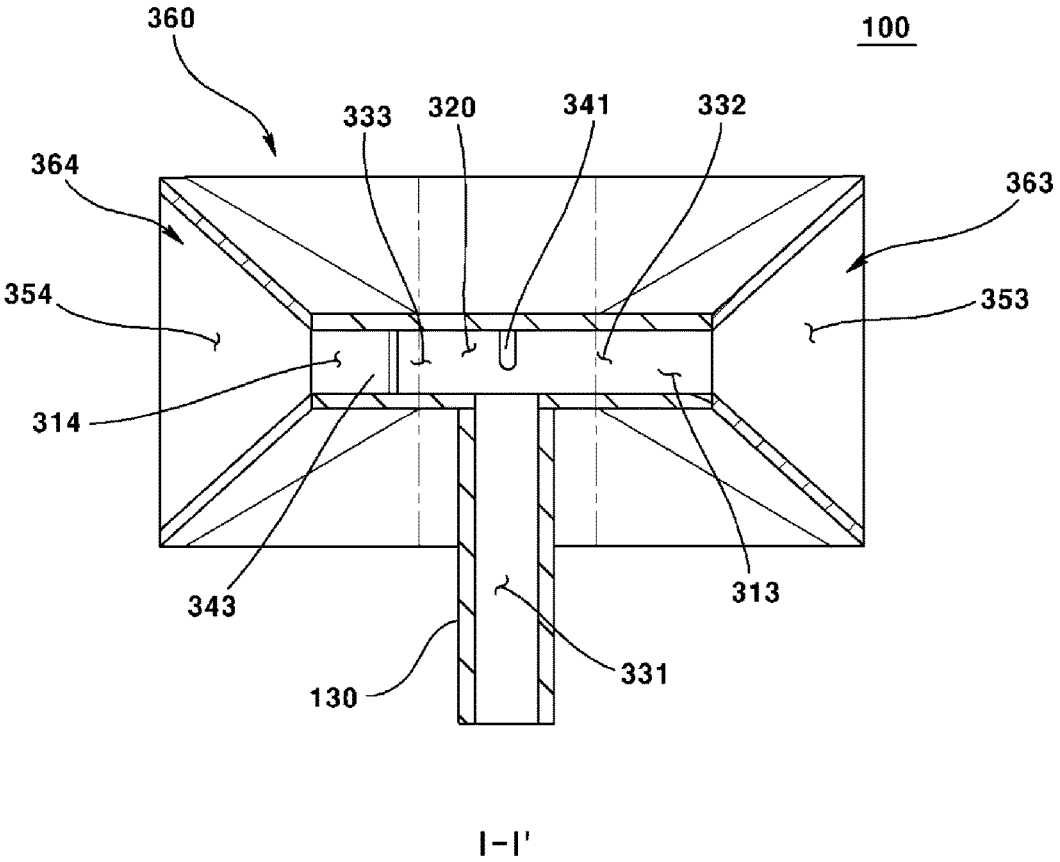
FIG. 4 is a cross-sectional view illustrating l-l' planes of an antenna according to an embodiment.
Figure 5:
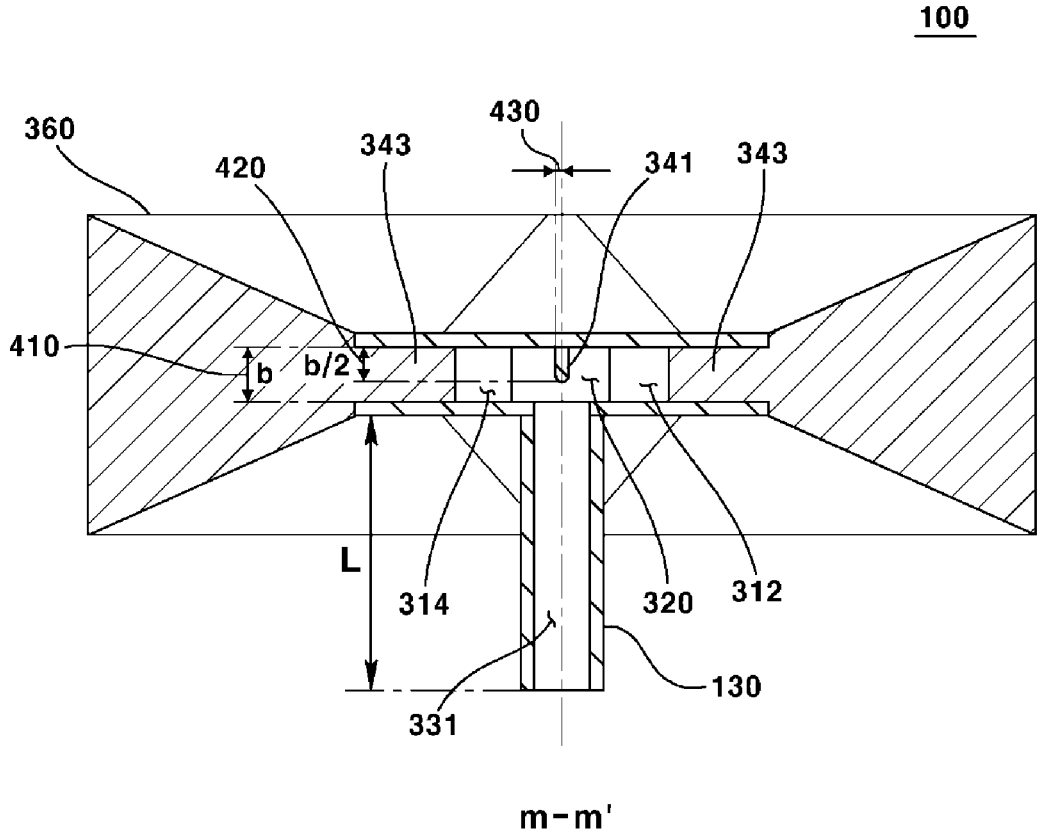
FIG. 5 is a diagram illustrating a cross-sectional view illustrating an m-m' planes of the antenna in relation to the length of a first waveguide.

Referring to FIG. 2, the antenna 100 may include an antenna unit 360 and a first waveguide 130. The first waveguide 130 may be connected to the antenna unit 360. A detailed connection relationship and internal configuration between the first waveguide 130 and the antenna unit 360 are illustrated in FIGS. 3 to 5.

Figure 3:
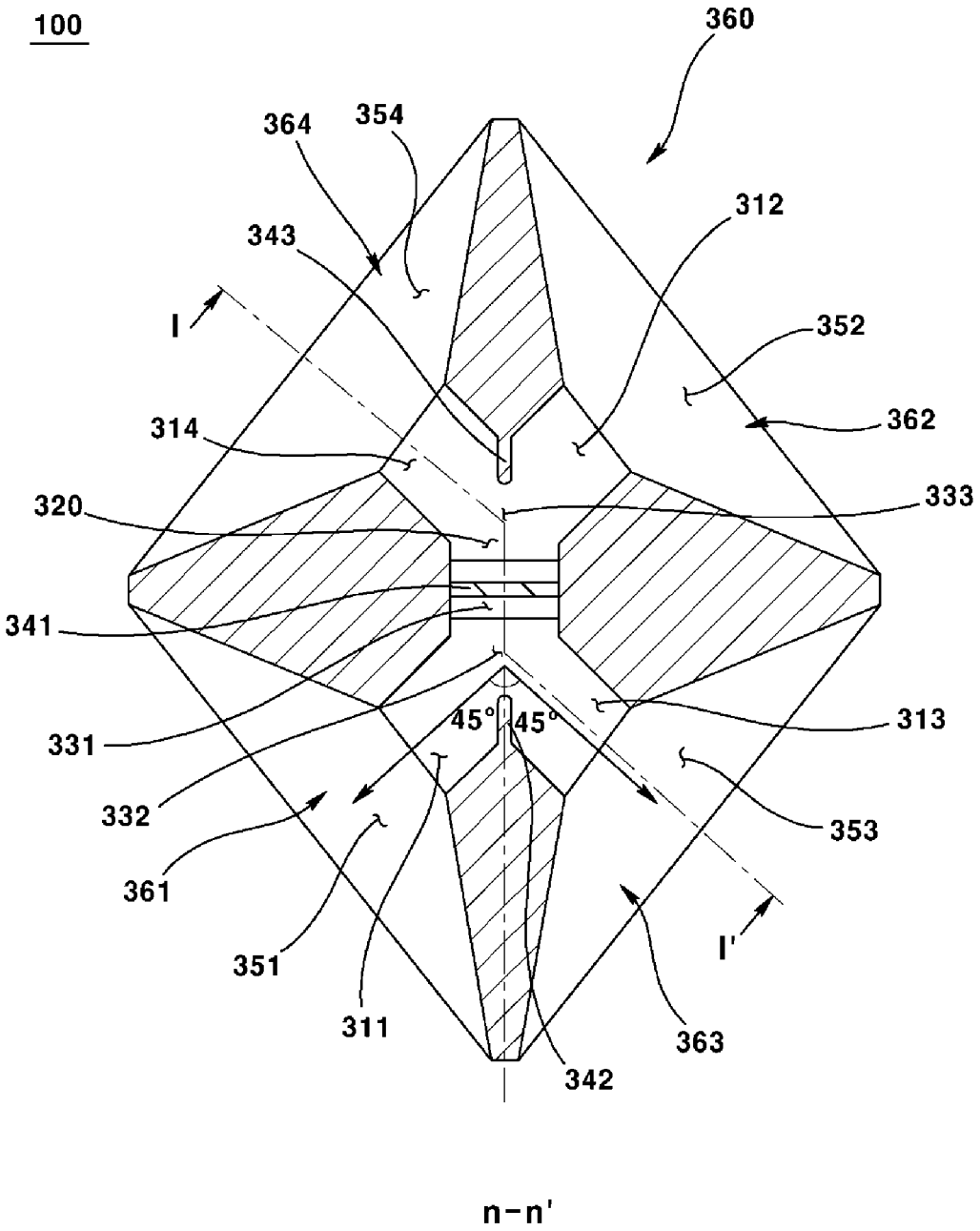
FIG. 3 is a cross-sectional view illustrating an n-n' planes of an antenna according to an embodiment.

FIG. 3 is a cross-sectional view showing n-n' planes of an antenna 100 according to an embodiment.

The antenna unit 360 may include a plurality of antenna units. For example, the antenna unit 360 may include a first antenna unit 361 and a second antenna unit 362, or may include a third antenna unit 363 and a fourth antenna unit 364.

Referring to FIG. 3, the antenna unit 360 may include a first antenna unit 361, a second antenna unit 362, a third antenna unit 363, and a fourth antenna unit 364.

The first antenna unit 361 may be connected to a first opening 311, the second antenna unit 362 may be connected to a first opening 312, the third antenna unit 363 may be connected to a first opening 313, and the fourth antenna unit 364 may be connected to a first opening 314. Or, the first antenna unit 361 may include the first opening 311, the second antenna unit 362 may include the first opening 312, the third antenna unit 363 may include the first opening 313, and the fourth antenna unit 364 may include the first opening 314.

The antenna unit 360 may include a second waveguide 320, and the second waveguide 320 may be connected to the first waveguide 130. Or, the antenna unit 360 may be connected to the second waveguide 320.

The first waveguide 130 may include a first signal transmission path 331, and the second waveguide 320 may include a second signal transmission path 332 and a third signal transmission path 333. In addition, the antenna unit 360 may include first openings 311, 312, 313, and 314. Referring to FIG. 3, the first openings 311, 312, 313, and 314 may mean openings inside the antenna unit 360. The first openings 311, 312, 313, and 314 may be connected to the second waveguide 320.

The first opening 311 of the first antenna unit 361 may be connected to the second opening 351 of the first antenna unit 361 through a second signal transmission path 332.

The first opening 312 of the second antenna unit 362 may be connected to the second opening 352 of the second antenna unit 362 through a third signal transmission path 333.

The first opening 313 of the third antenna unit 363 may be connected to the second opening 353 of the third antenna unit 363 through a second signal transmission path 332.

The first opening 314 of the fourth antenna unit 364 may be connected to the second opening 354 of the fourth antenna unit 364 through a third signal transmission path 333.

The first waveguide 130 may include a first signal transmission path 331.

The second waveguide 320 is connected to the first waveguide 130 and may include a second signal transmission path 332 and a third signal transmission path 333.

The antenna unit 360 is connected to the second waveguide 320 and may include first openings 311, 312, 313, and 314.

The second waveguide 320 may include a first separator 341 that separates the first signal transmission path 331 into a second signal transmission path 332 and a third signal transmission path 333.

The second opening 351 of the first antenna unit 361 is connected to the second signal transmission path 332, and the second opening 352 of the second antenna unit 362 is connected to the third signal transmission path 333, and the second opening 353 of the third antenna unit 363 is connected to the second signal transmission path 332, and the second opening 354 of the fourth antenna unit 364 may be connected to the third signal transmission path 333.

The second signal transmission path 332 and the third signal transmission path 333 may be perpendicular to the first signal transmission path 331.

The second waveguide 320 may include a second separator 342 that separates the second signal transmission path 332 into two signal transmission paths.

The second waveguide 320 may include a third separator 343 that separates the third signal transmission path 333 into two signal transmission paths.

The antenna unit 360 may include a third antenna unit 363 adjacent to the first antenna unit 361 and a fourth antenna unit 364 adjacent to the second antenna unit 362.

The second separator 342 of the second waveguide 320 is disposed between the first antenna unit 361 and the third antenna unit 363, and the third separator 343 of the second waveguide 320 may be disposed between the second antenna unit 362 and the fourth antenna unit 364.

The first antenna unit 361 and the second antenna unit 362 may be disposed in opposite directions to each other, and the third antenna unit 363 and the fourth antenna unit 364 may be disposed in opposite directions to each other.

The first antenna unit 361 and the second antenna unit 362 include second openings 351 and 352 that are larger than the first openings 311 and 312, and the second opening 351 of the first antenna unit 361 and the second opening 352 of the second antenna unit 362 may be disposed in opposite directions to each other.

The third antenna unit 363 and the fourth antenna unit 364 include second openings 353 and 354 that are larger than the first openings 313 and 314, and the second opening 353 of the third antenna unit 363 and the second opening 354 of the fourth antenna unit 364 may be disposed in opposite directions to each other.

The antenna 100 according to an embodiment may include a first waveguide 130, a second waveguide 320 disposed in a vertical direction with respect to the first waveguide, and an antenna unit 360 disposed in a horizontal direction with respect to the second waveguide. In addition, the antenna unit 360 may include a first antenna unit 361 disposed in a first direction, a second antenna unit 362 disposed in a second direction opposite to the first direction, a direction perpendicular to the first direction, a third antenna unit 363 disposed in a direction perpendicular to the first direction, and a fourth antenna unit 364 disposed in a direction perpendicular to the second direction.

In addition, the second waveguide 320 of the antenna 100 may include a first separator 341 disposed to be corresponding to the first waveguide 130, a second separator 342 disposed between the first antenna unit 361 and the third antenna unit 363, and a third separator 343 disposed between the second antenna unit 362 and the fourth antenna unit 364.

FIG. 4 is a cross-sectional view illustrating the l-l' plane of the antenna 100 according to an embodiment.

The third antenna unit 363 and the fourth antenna unit 364 may be connected to the first openings 313 and 314 and the second openings 353 and 354. Or, the third antenna unit 363 and the fourth antenna unit 364 may include first openings 313 and 314 and second openings 353 and 354.

The antenna unit 360 may include a second waveguide 320, and the second waveguide 320 may be connected to the first waveguide 130.

The first waveguide 130 may include a first signal transmission path 331, and the second waveguide 320 may include a second signal transmission path 332 and a third signal transmission path 333. In addition, the antenna unit 360 may include first openings 313 and 314. Referring to FIG. 4, the first openings 313 and 314 may mean openings inside the antenna unit 360. The first openings 313 and 314 may be connected to the second waveguide 320.

The first opening 313 of the third antenna unit 363 may be connected to the second opening 353 of the third antenna unit 363 through a second signal transmission path 332.

The first opening 312 of the second antenna unit 362 may be connected to the second opening 352 of the second antenna unit 362 through a third signal transmission path 333.

The first waveguide 130 may include a first signal transmission path 331.

The second waveguide 320 is connected to the first waveguide 130 and may include a second signal transmission path 332 and a third signal transmission path 333.

The antenna unit 360 is connected to the second waveguide 320 and may include first openings 313 and 314.

The second waveguide 320 may include a first separator 341 that separates the first signal transmission path 331 into a second signal transmission path 332 and a third signal transmission path 333.

The second opening 353 of the third antenna unit 363 is connected to the second signal transmission path 332, and the second opening 354 of the fourth antenna unit 364 may be connected with the third signal transmission path 333.

The second signal transmission path 332 and the third signal transmission path 333 may be perpendicular to the first signal transmission path 331.

FIG. 5 is illustrating a cross-sectional view m-m' plane of the antenna 100 in relation to the length of the first waveguide 130.

Referring to FIG. 5, the first waveguide 130 has a shape of a square pillar, and the length L of the first waveguide 130 may be longer than the wavelength of an electromagnetic wave signal.

The length L of the first waveguide 130 may be determined according to the frequency or wavelength of an electromagnetic wave signal to be used. In addition, according to an embodiment, by making the length L of the first waveguide 130 to be longer than the wavelength of the electromagnetic wave signal, the efficiency of transmission and/or distribution of the electromagnetic wave signal may be improved.

The first separator 341 may divide the electromagnetic wave signal transmitted from the first waveguide 130 to the antenna unit 360 into a plurality of side surfaces. Specifically, the electromagnetic wave signal transmitted to the antenna unit 360 through the first waveguide 130 may be distributed to the right and left sides with respect to the first separator 341. According to an embodiment, the electromagnetic wave signal transmitted from the first waveguide 130 to the antenna unit 360 through the first separator 341 may be divided in half to the right and left, but substantially exactly 50%. It may not be possible, and the distribution ratio may be changed according to the actual implementation situation.

The size of the first separator 341 may be determined according to an embodiment. For example, the length 420 of the first separator 341 may be b/2 of the thickness 410 of the second waveguide 320 inside the antenna unit 360, but is not limited thereto.

According to an embodiment, an end portion of the first separator 341 may have a partial shape of a sphere. For example, an end portion of the first separator 341 may be hemispherical. For example, the first separator 341 may have a shape in which a cylindrical shape and a hemispherical shape are combined. When the end portion of the first separator 341 is spherical, the curvature may be determined according to the radius 430. For example, the radius 430 may be about 0.5 mm, but is not limited thereto.

Figure 6:
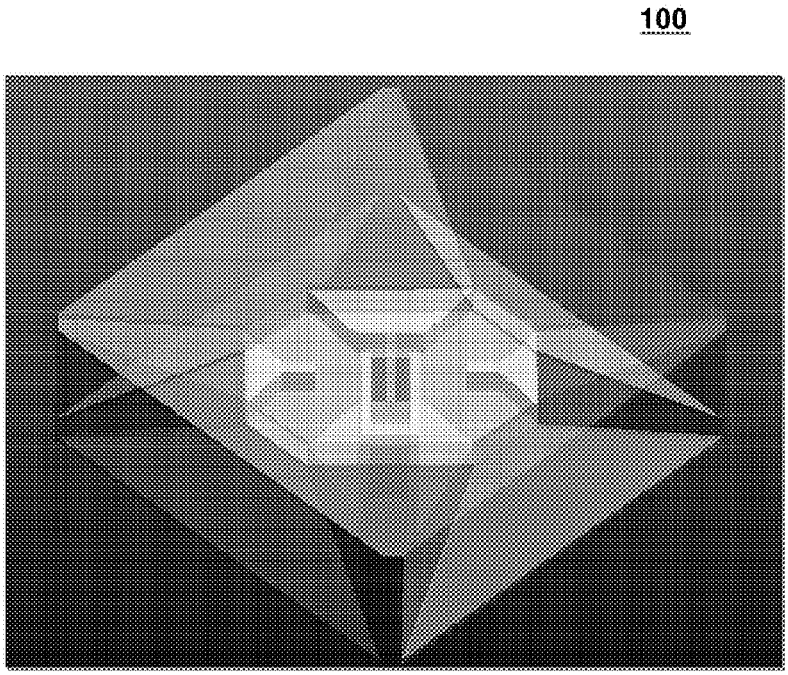
FIG. 6 is a diagram illustrating a perspective view of an antenna according to an embodiment.

FIG. 6 is a view illustrating a see-through view of the antenna 100 according to an embodiment.

Referring to FIG. 6, the electromagnetic wave signal transmitted through the first waveguide 130 is divided in half through the first separator 341, and the electromagnetic wave signal divided in half is again divided in half through the second separator 342 or the third separator 343 and may be radiated to the outside of the antenna 100.

Or, the electromagnetic wave signal received through the antenna unit 360 is applied to the first waveguide 130, and the first waveguide 130 may transmit the received electromagnetic wave signal to a circuit connected to the first waveguide 130.

Figure 7:
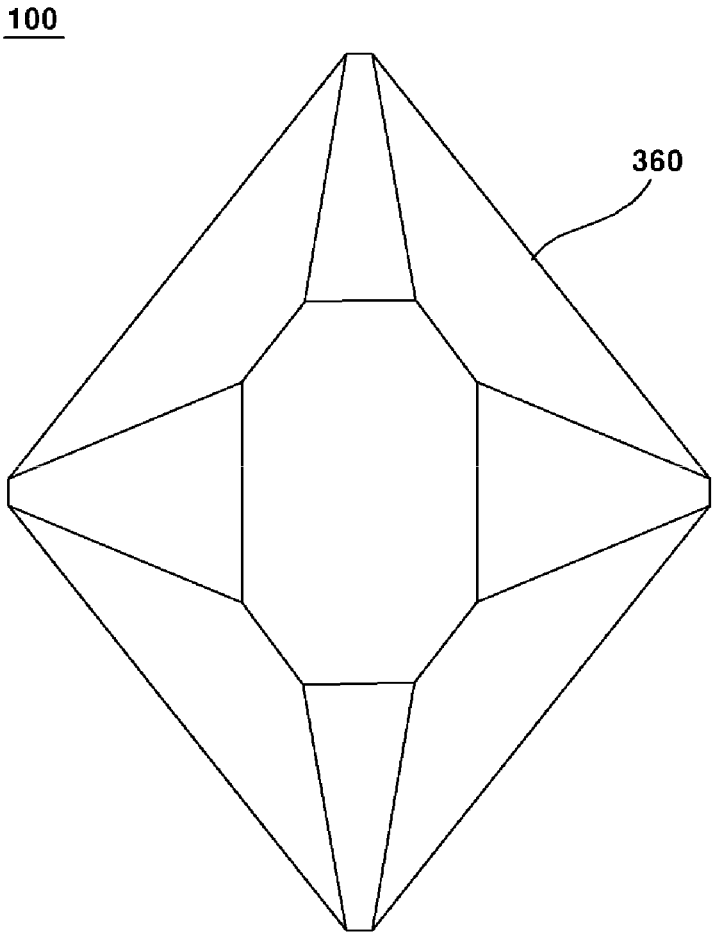
FIG. 7 is a plan view illustrating an antenna according to an embodiment.

FIG. 7 is a plan view illustrating an antenna 100 according to an embodiment.

Referring to FIG. 7, a case in which the antennas 100 are pointing four directions will be described. When the antennas 100 are pointing four directions, a plan view of the antennas 100 may have a shape similar to a square. As illustrated in FIG. 7, in a process in which the antennas 100 are actually manufactured, a corner portion of the antenna unit 360 may not have an ideal rectangular vertex shape. Accordingly, the actual shape of the plan view of the antenna unit 360 may not be a completely rectangular shape.

Figure 8:
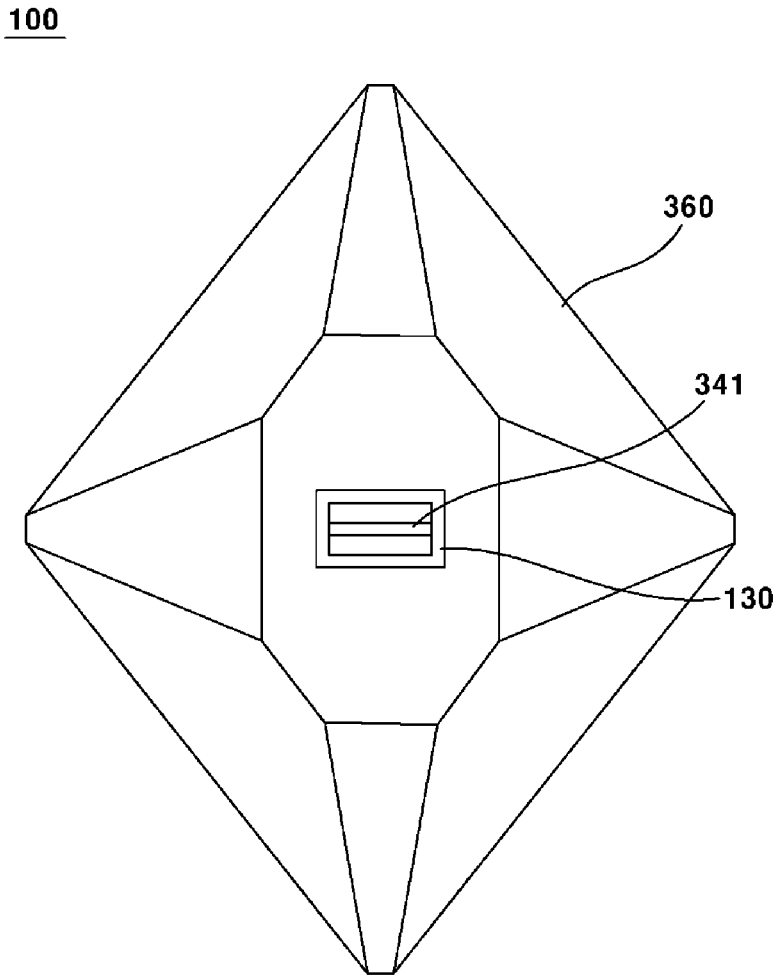
FIG. 8 is a diagram illustrating a bottom view of an antenna according to an embodiment.

FIG. 8 is a view showing a bottom view of the antenna 100 according to an embodiment.

Referring to FIG. 8, a first separator 341 can be checked through the first waveguide 130 which is hollow. The electromagnetic wave signal transmitted through the first waveguide 130 may be divided in half through the first separator 341 and emitted in a plurality of directions.

As can be seen in FIGS. 7 and 8, the shape of the plan view and the shape of the bottom view of the antenna 100 may be symmetrical.

Figure 9:
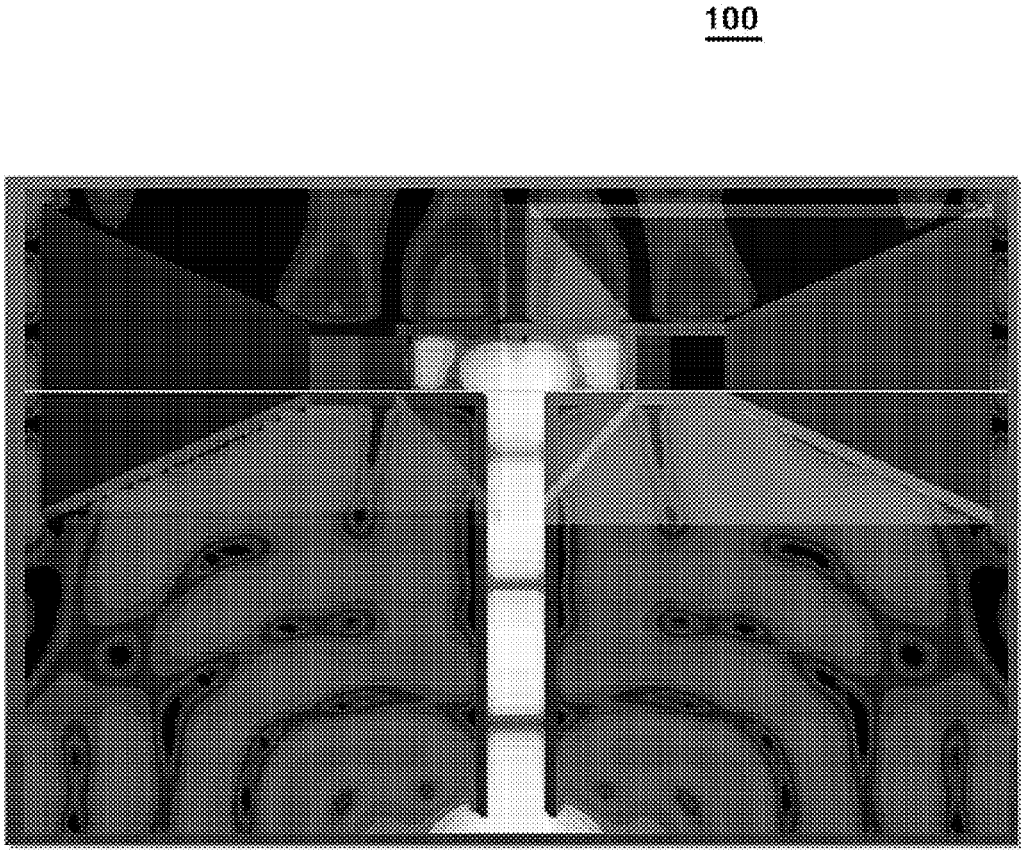
FIG. 9 is a diagram illustrating a cross-sectional view of an antenna emitting an electromagnetic wave signal from one side according to an embodiment.
Figure 10:
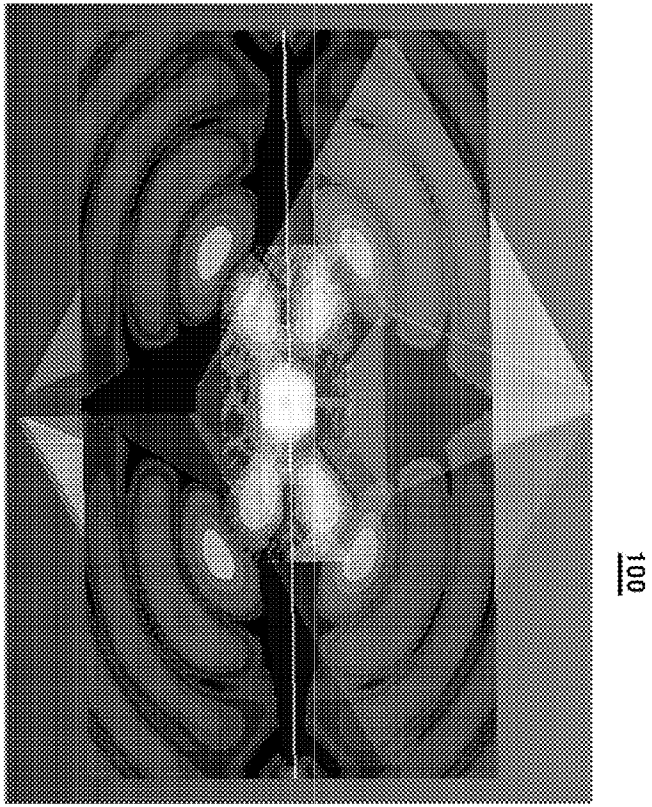
FIG. 10 is a diagram illustrating a perspective view of an antenna emitting an electromagnetic wave signal according to an embodiment.

FIG. 9 is a diagram illustrating a cross-sectional view of an antenna 100 emitting an electromagnetic wave signal from one side according to an embodiment. Referring to FIG. 9, it can be seen that the electromagnetic wave signal applied to the first waveguide 130 is transmitted to a plurality of sides through a kind of T junction shape. FIG. 10 is a diagram illustrating a see-through view of an antenna 100 that emits an electromagnetic wave signal according to an embodiment. Referring to FIG. 10, it can be seen that the electromagnetic wave signal applied to the first waveguide 130 is transmitted to the antenna unit 360 and emitted through first to fourth antenna units.

Figure 11:
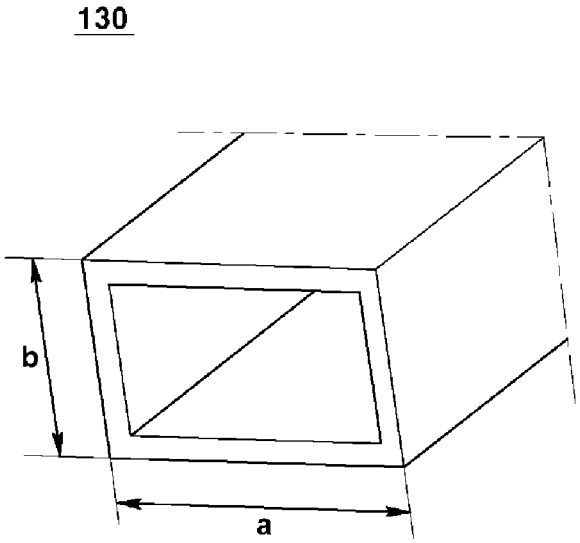
FIG. 11 is a diagram illustrating a first waveguide according to an embodiment.

FIG. 11 is a diagram illustrating a first waveguide 130 according to an embodiment.

The first waveguide 130 according to an embodiment has a shape of a square pillar, and a horizontal length a and a vertical length b of a cross-section of the first waveguide 130 may be determined according to a frequency of an electromagnetic wave signal. A specific example is disclosed in FIG. 12 in which the horizontal length a and the vertical length b of the cross-section of the first waveguide 130 are determined according to the frequency of the electromagnetic wave signal.

FIG. 12 is a diagram for describing the size of the first waveguide 130 according to an embodiment.

Referring to FIG. 12, the size of the first waveguide 130 may be determined according to the frequency of the used electromagnetic wave signal. Specifically, the horizontal length a and the vertical length b of the cross-section of the first waveguide 130 may be determined according to the frequency of the electromagnetic wave signal to be used.

For example, by determining the horizontal length a and the vertical length b to be 8.64 mm and 4.32 mm, respectively, the first waveguide 130 may cover the entire 5G band. However, the value may be changed within a reasonable range depending on the thickness of the material of the first waveguide 130 or measurement error and the like. For example, the horizontal length a of the cross-section of the first waveguide 130 may be about 8 mm to 9 mm, and the vertical length b of the cross-section of the first waveguide 130 may be about 4 mm to 5 mm.

However, the specific numerical values in FIG. 12 are only an example, and the scope of rights is not interpreted to be limited to such numerical values.

The first waveguide 130 according to an embodiment may be used as a transmission path for transmitting electrical energy or a signal (e.g., an electromagnetic wave signal) of a high frequency (1 GHz or above) of microwave or higher.

Figure 13:
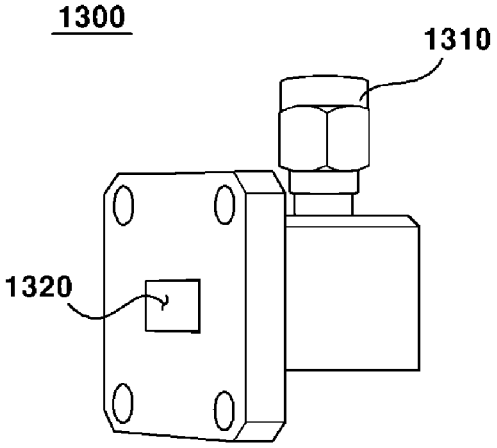
FIG. 13 is a diagram illustrating an example of gender used to transmit an electromagnetic wave signal according to an embodiment.

FIG. 13 is a diagram illustrating an example of a gender 1300 used to transmit an electromagnetic wave signal according to an embodiment.

The gender 1300 according to an embodiment may be used to connect a first waveguide 130 and a circuit. For example, a first connecting unit 1310 may be connected to a cable, and a second connecting unit 1320 may be connected to the first waveguide 130. The electromagnetic wave signal may be transmitted between the first waveguide 130 and the cable through the gender 1300, and the electromagnetic wave signal may be transmitted to the circuit through the cable. Or, the electromagnetic wave signal generated in the circuit may be transmitted to the first waveguide 130 through the cable and the gender 1300.

Those of ordinary skill in the technical field related to the present embodiment will appreciate that it may be implemented in a modified form without departing from the essential characteristics of the above-described description. Therefore, the disclosed methods should be considered from an explanatory point of view rather than a limiting point of view. The scope of the present invention is shown in the claims rather than the above description, and all differences within the scope equivalent thereto should be construed as being included in the present invention.

The invention claimed is:

1. An antenna comprising:

a first waveguide having a first signal transmission path;

a second waveguide connected to the first waveguide and having a second signal transmission path and a third signal transmission path; and an antenna unit connected to the second waveguide and having a first opening, wherein the second waveguide includes a first separator separating the first signal transmission path from the second signal transmission path and the third signal transmission path, wherein the antenna unit includes a first antenna and a second antenna, wherein the first opening of the first antenna is connected to the second signal transmission path, and the first opening of the second antenna is connected to the third signal transmission path, and wherein the second waveguide includes a second separator separating the second signal transmission path into two signal transmission paths.

2. The antenna according to claim 1, wherein the second signal transmission path and the third signal transmission path are in a vertical direction to the first signal transmission path.

3. The antenna according to claim 1, wherein the second waveguide includes a third separator separating the third signal transmission path into two signal transmission paths.

4. The antenna according to claim 3, wherein the antenna unit includes a third antenna adjacent to the first antenna and a fourth antenna adjacent to the second antenna.

5. The antenna according to claim 4, wherein the second separator of the second waveguide is disposed between the first antenna unit and the third antenna unit, and the third separator of the second waveguide is disposed between the second antenna unit and the fourth antenna unit.

6. The antenna according to claim 5, wherein the first antenna and the second antenna are disposed in an opposite direction from each other, and the third antenna and fourth antenna are disposed in an opposite direction from each other.

7. The antenna according to claim 6, wherein the first antenna and the second antenna include a second opening larger than the first opening, and the second opening of the first antenna and the second opening of the second antenna are disposed in opposite directions from each other.

8. The antenna according to claim 1, wherein the first waveguide is a shape of a square pillar.

9. The antenna according to claim 1, wherein a length of the first waveguide is longer than a wavelength of an electromagnetic wave signal.

10. The antenna according to claim 1, wherein a length of the first waveguide is determined according to a frequency or a wavelength of an electromagnetic wave signal to be used.

11. The antenna according to claim 1, wherein a length of the first waveguide is determined according to a frequency or a wavelength of an electromagnetic wave signal to be used.

12. The antenna according to claim 1, wherein the first separator divides an electromagnetic wave signal transmitted from the first waveguide to the antenna into a plurality of side surfaces.

13. The antenna according to claim 12, wherein the electromagnetic wave signal is distributed to a right side and a left side with respect to the first separator.

14. The antenna according to claim 13, wherein the electromagnetic wave signal is distributed in half to the right side and the left side.

15. The antenna according to claim 1, wherein an electromagnetic wave signal transmitted through the first waveguide is divided in half through the first separator, and the electromagnetic wave signal divided in half is divided in half through the second separator or a third separator to be radiated to the outside of the antenna.

16. The antenna according to claim 1, wherein a length of the first separator is a half of a thickness of the second waveguide.

17. The antenna according to claim 1, wherein an end portion of the first separator is hemispherical.

18. An antenna comprising:

a first waveguide;

a second waveguide disposed in a direction perpendicular to the first waveguide; and an antenna unit disposed in a horizontal direction with the second waveguide, wherein the antenna unit includes a first antenna disposed in a first direction, a second antenna disposed in a second direction opposite to the first direction, a third antenna disposed in a direction perpendicular to the first direction, and a fourth antenna disposed in a direction perpendicular to the second direction, and wherein the second waveguide includes a first separator disposed to correspond to the first waveguide, a second separator disposed between the first antenna and third antenna, and a third separator disposed between the second antenna and the fourth antenna.

19. An antenna comprising:

a first signal transmission path;

a first separator separating the first signal transmission path into second and third signal transmission paths;

a second separator separating the second signal transmission path into fourth and fifth signal transmission paths;

a third separator separating the third signal transmission path into sixth and seventh signal transmission paths;

a plurality of antenna corresponding to the fourth, fifth, sixth and seventh signal transmission paths separated by the second and third separators, wherein the plurality of antenna face different directions from one another.

* * * * *